United States Patent [19]

Setzke

[11] Patent Number: 4,746,078

[45] Date of Patent: May 24, 1988

[54] REEL LIFTING AND SUPPORT DEVICE

[76] Inventor: William H. Setzke, Rte. 1, Box 52A, Frankfort, Ill. 60423

[21] Appl. No.: 931,409

[22] Filed: Nov. 14, 1986

[51] Int. Cl.[4] ..... B65H 54/553; B65H 75/40

[52] U.S. Cl. ..... 242/94; 242/129.6

[58] Field of Search ..... 242/94, 85, 86.4, 129.6, 242/129, 78.8, 78.6, 129.62, 86.6

[56] References Cited

U.S. PATENT DOCUMENTS

| | | | |
|---|---|---|---|
| 199,631 | 1/1878 | Felix et al. | 242/129.6 |
| 970,884 | 9/1910 | Carter | 242/129.6 |
| 1,404,672 | 1/1922 | Walker | 242/85 |
| 1,509,717 | 9/1924 | Davis | 242/129.6 |
| 2,601,960 | 7/1952 | Hick | 242/129.6 |
| 2,610,003 | 9/1952 | Bond et al. | 242/86.4 |
| 3,069,110 | 12/1962 | Domer | 242/129.6 |
| 3,120,358 | 2/1964 | Ensley | 242/129.6 |
| 3,298,667 | 1/1967 | Grantham et al. | 242/85 X |
| 3,304,060 | 2/1967 | Wanless et al. | 254/131 |
| 4,172,608 | 10/1979 | Brown, Jr. | 242/85 |
| 4,469,289 | 9/1984 | Gebo | 242/85 |

FOREIGN PATENT DOCUMENTS

| | | | |
|---|---|---|---|
| 449159 | 8/1927 | Fed. Rep. of Germany | 242/129.6 |
| 983115 | 6/1951 | France | 242/129.6 |
| 1453267 | 8/1966 | France | 242/86.6 |
| 184265 | 5/1936 | Switzerland | 242/129.6 |
| 1504509 | 3/1978 | United Kingdom | 242/86.6 |

*Primary Examiner*—Stuart S. Levy
*Assistant Examiner*—Joseph J. Hail, III

[57] ABSTRACT

An easily collapsible device for lifting a reel of cable off of a support surface and then supporting the reel in a stable position above the support surface for free rotation to allow removal of the cable, the device including a pair of indentical units one to be disposed on either side of the reel.

6 Claims, 2 Drawing Sheets

REEL LIFTING AND SUPPORT DEVICE

BACKGROUND OF THE INVENTION

The present invention is directed to devices which are sometimes referred to as "reel jacks". Such devices can be used to lift and/or support large, heavy reels of industrial cable off of the ground or other support surface to allow cable to be easily removed from the reel by simply pulling the cable and rotating the reel. Arrangements of this general type are shown in prior art U.S. Pat. Nos. 970,884, 1,404,672, 1,509,717, 2,601,960, 3,069,110, 3,120,358, 4,172,608 and 4,469,289. These arrangements are bulky, awkward to operate and not readily collapsible making transportation of the device from one job site to another cumbersome.

SUMMARY OF THE INVENTION

The present invention provides an easily collapsible, readily portable reel jack for lifting large reels of cable off the ground and then supporting the reel in a stable manner to allow ready removal of the reel contents. The device consists of a pair of identical units each including a lower support arm with a handle telescoped therein, an upwardly extending arm pivotally connected to the lower support arm, the upper arm having one or more sockets for receiving a horizontal support, a collapsible brace connected between the upper and lower arms, and a spacer on the lower surface of the lower arms to ensure adequate clearance for a hand between the handle and the floor surface. The reel jack may be easily collapsed for compact transport and storage.

DETAILED DESCRIPTION OF THE INVENTION

Figure 1:
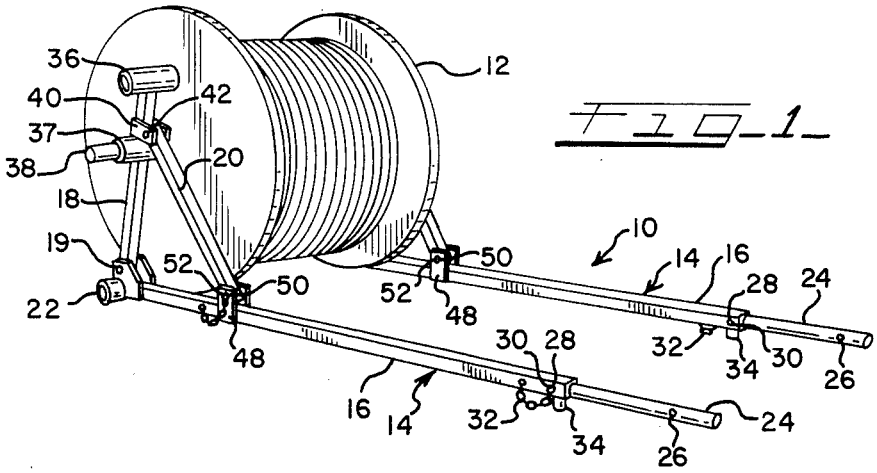
FIG. 1 shows a perspective view of the collapsible lifting and supporting device of the present invention with a cable reel in place, the reel being supported in a raised position so that the cable may be dispensed.
Figure 2:
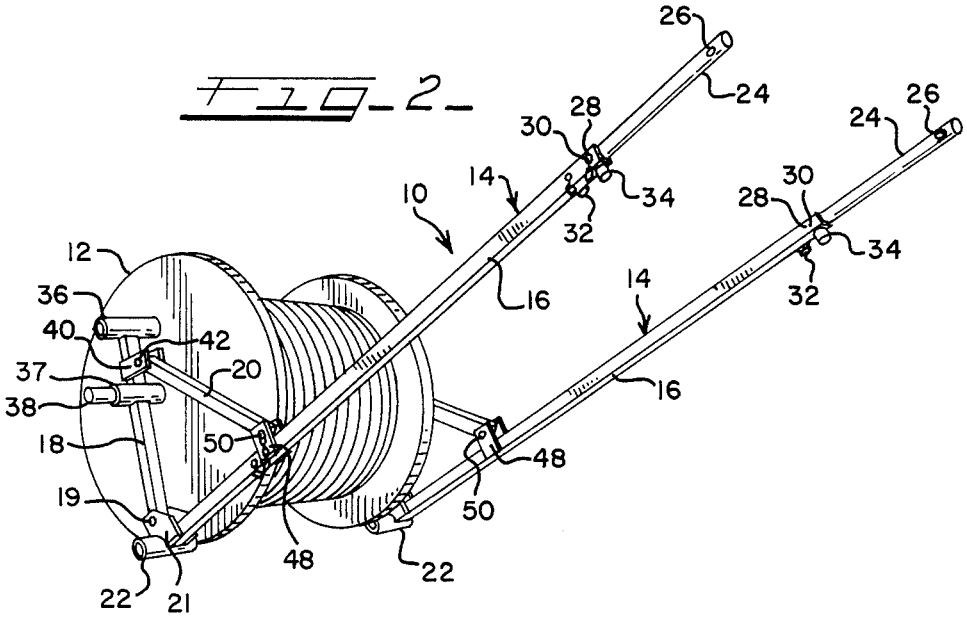
FIG. 2 shows a perspective view of the device with a cable reel resting on a support surface and prior to being raised to the position of FIG. 1.

As illustrated in FIGS. 1 and 2, a collapsible device, generally designated as 10, for lifting and supporting reels 12 is provided. The device 10 consists of a pair of units 14 and 14A, each unit being substantially identical in construction. Each unit includes a longitudinally extending lower support arm 16, an upper support arm 18, and a brace member 20. The arms and brace may be formed of any appropriate structural steel or aluminum tubing. A pin 19 passes through support arm 18 and flanges 21 mounted on arm 16 thereby pivotally connecting the arms 16 and 18.

Figure 3:
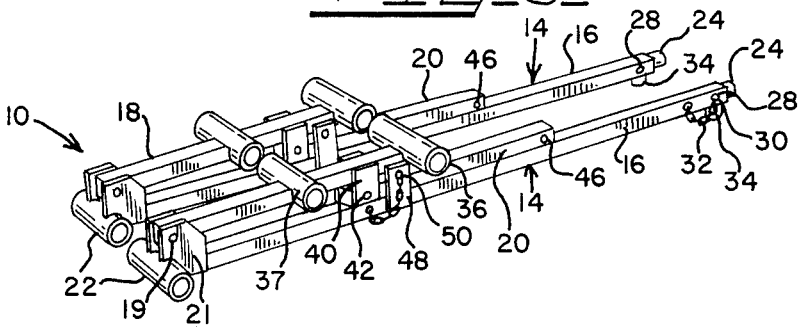
FIG. 3 shows a perspective view of the device with both units in a collapsed position.
Figure 4:
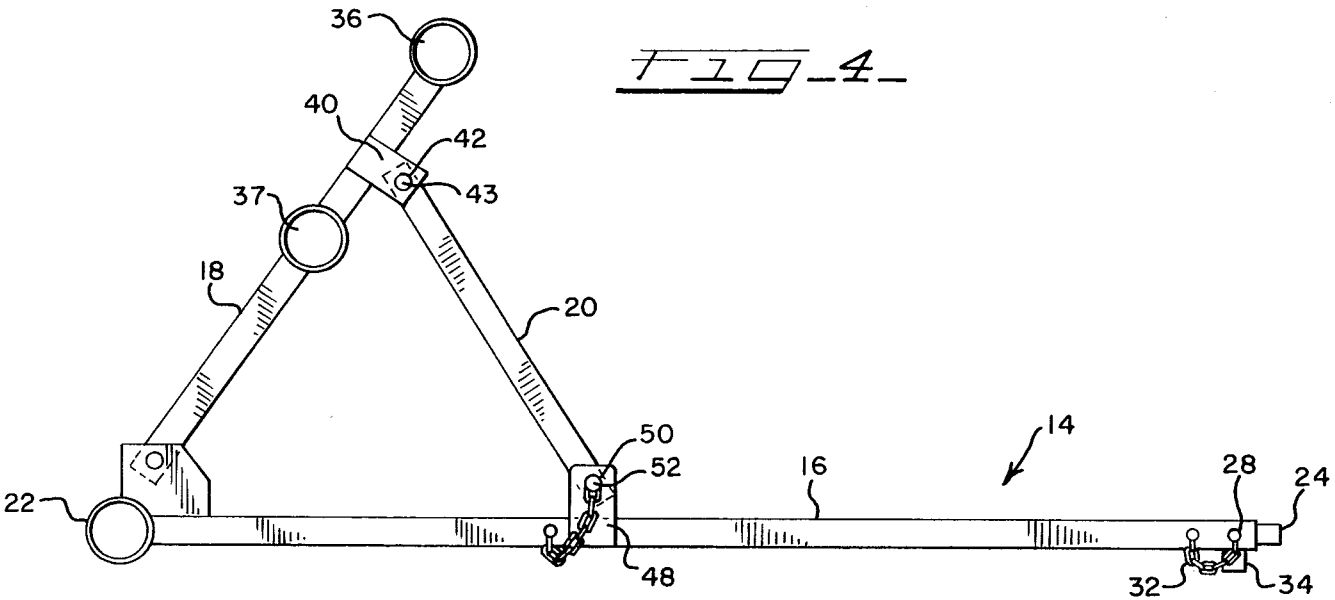
FIG. 4 shows a side elevational view of one unit of the device in a locked position.
Figure 5:
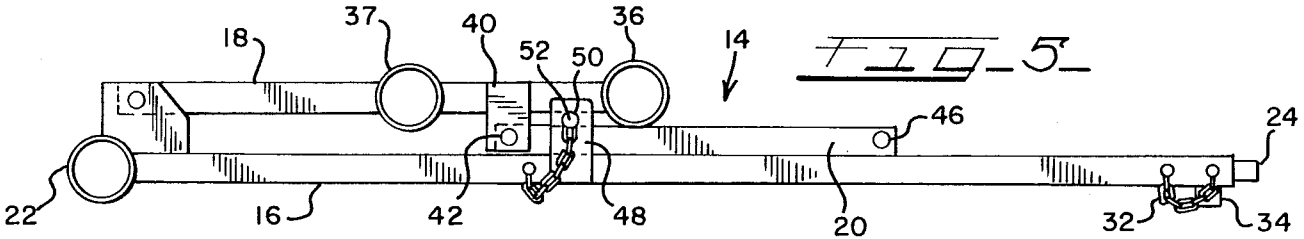
FIG. 5 shows a side elevational view of one unit of the device in a collapsed position.

The lower arm 16 is hollow and defines a fulcrum 22 at one end, the fulcrum 22 being shown in the form of a circular roller or pipe. A handle 24 is telescopically extendable from the lower arm 16 at the end opposite the fulcrum 22 as shown in FIGS. 1 and 2. The handle 24 is provided with an aperture 26 which may be aligned to correspond to an aperture 28 provided at the handle end of the lower arm 16. A pin 30 is secured to the lower support arm 16 by means of a chain 32 or any other means which would secure the pin 30 to the lower arm 16. When it is desired to extend the handle 24 from the arm 16, the pin 30 is removed permitting the handle 24 to slide out. A second aperture (not shown) is provided further down the handle 24 to be aligned with the aperture 28 in the lower support arm 16. The pin 30 is inserted through the aperture 28 and the second aperture to secure the handle 24 in its extended position as shown in FIGS. 1 and 2. When it is desired to collapse the handle 24, the pin 30 is removed, the handle 24 slid back into the lower arm 16, the aperture 26 in the handle 24 being realigned with the aperture 28 in the lower arm 16, and the pin 30 inserted therethrough as shown in FIGS. 3, 4 and 5 preventing the handle 24 from sliding out of the lower support arm 16.

A spacer 34 of suitable height is provided on the lower surface of the lower arm 16 to position the lower arm 16 above the support surface a distance sufficient to allow adequate clearance for the insertion of fingers so that the lower arms may be easily grasped for lifting when the device is in its supporting position, as shown in FIG. 1.

A plurality of sockets 36 and 37 are positioned on upper arm 18. Each socket is adapted to receive a horizontal support 38, shown as a pipe or tube, for a cable reel so that reels of varying diameters may be lifted and supported by the device 10. Although two sockets 36 and 37 are illustrated, additional sockets could be added depending upon the variety of the diameter of reels to be handled in any given environment.

A pair of plates 40 are provided, one extending from either side of the arm 18 with apertures 42 formed in the plates 40. A pin 43 passes between the plates 40 and the brace 20 pivotally connecting the brace 20 to the arm 18. At the opposite end, the brace 20 is provided with an aperture 46 and may be releasably secured to the lower arm 16 of the unit 14 between a pair of plates 48 extending from the lower arm. A pair of corresponding apertures 50 are provided in the plates 48 to receive a pin 52. When pin 52 is inserted through the apertures 50 and the aperture 46 provided in the brace 20, this secures the brace 20 to the lower arm 16 in a locked position as shown in FIG. 4. The pin 52 may be fastened to the lower arm 16 by a chain in the same fashion that the pin 30 is secured to the lower arm 16 at the handle end. The included angle between the upper arm 18 and the lower arm 16, when the unit 14 is in its locked position, is approximately 80°. This results in a stable overcenter support as opposed to relatively unstable prior art arrangements.

When the units 14 and 14A of the device 10 are in a collapsed position, as shown in FIGS. 3 and 5, and it is desired to lift and support a cable reel 12 at a job site, the pin 52 is withdrawn from the aperture 50 and the upper arm 18 of each unit is lifted upward so that arm 18 pivots about pin 19 until it reaches the position shown in FIG. 4. The aperture 46 provided in the lower end of the brace 20 is then aligned with the apertures 50 between the plates 48 and the pin 52 inserted therethrough securing the brace 20 in its locked position. The units 14 and 14A are then positioned on opposite sides of the reel and opposing corresponding sockets 36 or 37 are aligned with the central aperture of the reel 12, and the horizontal support 38 is inserted through both sockets and the reel. The device 10 now appears as illustrated in FIG. 2 of the drawings, with the lower arms 16 extending upwardly at approximately a 45° angle from the ground and the fulcrum 22 in contact with the ground. If desired, the cable reel may be transported from one location to another using the cable reel itself as a wheel and the arms 16 as steering levers in the same manner as one would transport a wheelbarrow. To accomplish this, the arms are rotated counterclockwise about 90° from the position shown in FIG. 2 until they are substantially parallel to the ground.

To raise the reel from the position illustrated in FIG. 2, downward pressure is exerted on the arms 16 causing the device 10 to pivot about the fulcrum 22, thereby raising the cable reel 12 above the ground to the FIG. 1 position so that the cable may be dispensed therefrom. The arms 16 are pivoted until they assume the position shown in FIG. 1 where the arms are substantially parallel to the ground with the spacers 34 engaging the ground.

In this position (FIG. 1), the device functions as a support stand which is stable due to the over-center relationship and supports the reel at a slight distance off the ground allowing the reel to rotate when removal of the contents is desired. When use of the reel is finished, the arms 16 are simultaneously raised to the position of FIG. 2, the pipe or horizontal support 38 is removed and the units 14 and 14A may be collapsed for storage or transport.

When it is desired to collapse the units, the pin 52 is removed from the aperture 50 in each unit. The handles 24 are pushed back into the arms 16 as previously described. The upper arm 18 is then lowered toward the lower arm 16, pivoting about pin 19, by grasping the brace 20 and pulling it downward and outward until the upper arm 18 is parallel to and spaced above the lower arm 16 and the brace 20 is resting atop the lower arm 16, as best shown in FIGS. 3 and 5. The aperture 50 is aligned with a space between the arm 18 and brace 20 and the pin 52 is then inserted through the aperture 50 firmly securing the upper arm 18, the brace 20, and the lower arm 16 together for ease of storage and transport. It would also be within the purview of the present invention to reverse the locations of the removable fastener 52 and the pin 43.

Thus it has been shown that the present invention provides an easily collapsible lifting and supporting device for cable reels which pivots about a fulcrum and can support a reel off the ground in a stable position.

Various features of the invention have been particularly shown and described in connection with the illustrated embodiment of the invention, however, it must be understood that these particular arrangements merely illustrate and that the invention is to be given its fullest interpretation with the terms of the appended claims.

What is claimed is:

1. An easily collapsible, easily transportable and compact device for safely lifting, supporting and moving cable reels, said device consisting of a pair of units, each unit including a longitudinally extending lower support arm defining a fulcrum at one end thereof, an upper support arm pivotally connected to said lower support arm at the fulcrum end, a brace connectable between said lower and upper support arms adapted to assume a locked position, said brace rigidly supporting said upper arm at an acute angle with respect to said lower arm and adapted to assume a collapsed position in which said upper arm, said lower arm and said brace are all substantially parallel such that said device is substantially compact, releasable fastening means releasably connectable between a lower end of said brace and one of said support arms operable such that when so connected, said brace and said upper arm assume said locked position but when released, said brace and said upper arm assume said collapsed position, said releasable fastening means also engageable with an upper end of said brace when said brace is in said collapsed position to secure said unit in said collapsed position for ease of storage and transport at least one socket carried by said upper arm, said socket defining a substantially cylindrical tube adapted to receive a horizontal support for said cable reel, said device operable such that when one of said units is disposed on either side of a reel and a horizontal support is inserted through said socket of said first unit, through a central aperture of said reel and through said socket of said second unit, said device is operative to rollably transport said reel from one location to another by either pushing or pulling said lower arm and said device is operative to lift said reel by pivoting about said fulcrum until said reel is raised above its support surface and then to support said reel above said support surface for rotation of said reel and removal of the contents thereof.

2. A collapsible device as in claim 1 in which each unit includes a plurality of sockets carried by said upper arm spaced along said arm to lift and support reels of different diameter.

3. A collapsible device as in claim 1 in which said fulcrum is a circular roller.

4. A collapsible device as in claim 1 in which each unit includes a spacer provided on the lower surface of the lower arm to raise said lower arm above the support surface to allow clearance for insertion of fingers.

5. A collapsible device as in claim 1 in which each unit includes a handle telescopically extendable from said lower support arm at an end opposite said fulcrum.

6. A collapsible device as in claim 1 in which said acute angle between said upper arm and said lower arm in said locked position is substantially 80°.

* * * * *